US005574956A

United States Patent [19]

Malmstrom

[11] Patent Number: 5,574,956

[45] Date of Patent: Nov. 12, 1996

[54] METHOD AND APPARATUS FOR TREATMENT SULPHIDIC CONCENTRATES

[75] Inventor: Rolf Malmstrom, Helsinki, Finland

[73] Assignee: Outokumpu Engineering Contractors Oy, Espoo, Finland

[21] Appl. No.: 424,319

[22] PCT Filed: Oct. 19, 1993

[86] PCT No.: PCT/FI93/00428

§ 371 Date: Apr. 13, 1995

§ 102(e) Date: Apr. 13, 1995

[87] PCT Pub. No.: WO94/09166

PCT Pub. Date: Apr. 28, 1994

[30] Foreign Application Priority Data

Oct. 21, 1992 [FI] Finland ..... 924761

[51] Int. Cl.[6] ..... C21B 11/02

[52] U.S. Cl. ..... 419/45; 266/164; 266/166; 266/172; 423/42; 75/643; 75/429

[58] Field of Search ..... 423/48; 266/214, 266/144, 161, 162, 164, 166, 172; 75/643, 429; 419/45

[56] References Cited

U.S. PATENT DOCUMENTS

| | | | |
|---|---|---|---|
| 3,850,620 | 11/1974 | Themelis et al. | 75/74 |
| 4,416,690 | 11/1983 | Richards et al. | 75/26 |
| 4,544,141 | 10/1985 | Mackey et al. | 266/215 |

*Primary Examiner*—Charles T. Jordan
*Assistant Examiner*—Anthony R. Chi
*Attorney, Agent, or Firm*—Brooks Haidt Haffner & Delahunty

[57] ABSTRACT

A method for oxidizing treatment of molten matte and at the same time directly smelting sulphidic concentrate in a refractory-lined liquid bath reactor, e.g. a converter, into which oxidizing air is introduced below the surface of the liquid bath. For additional supply of energy in order to achieve thermal balance or increase of capacity, sulphidic concentrate is introduced into the gas phase of the liquid bath reactor together with oxygen gas or oxygen-enriched gas by means of a concentrate burner.

10 Claims, 1 Drawing Sheet

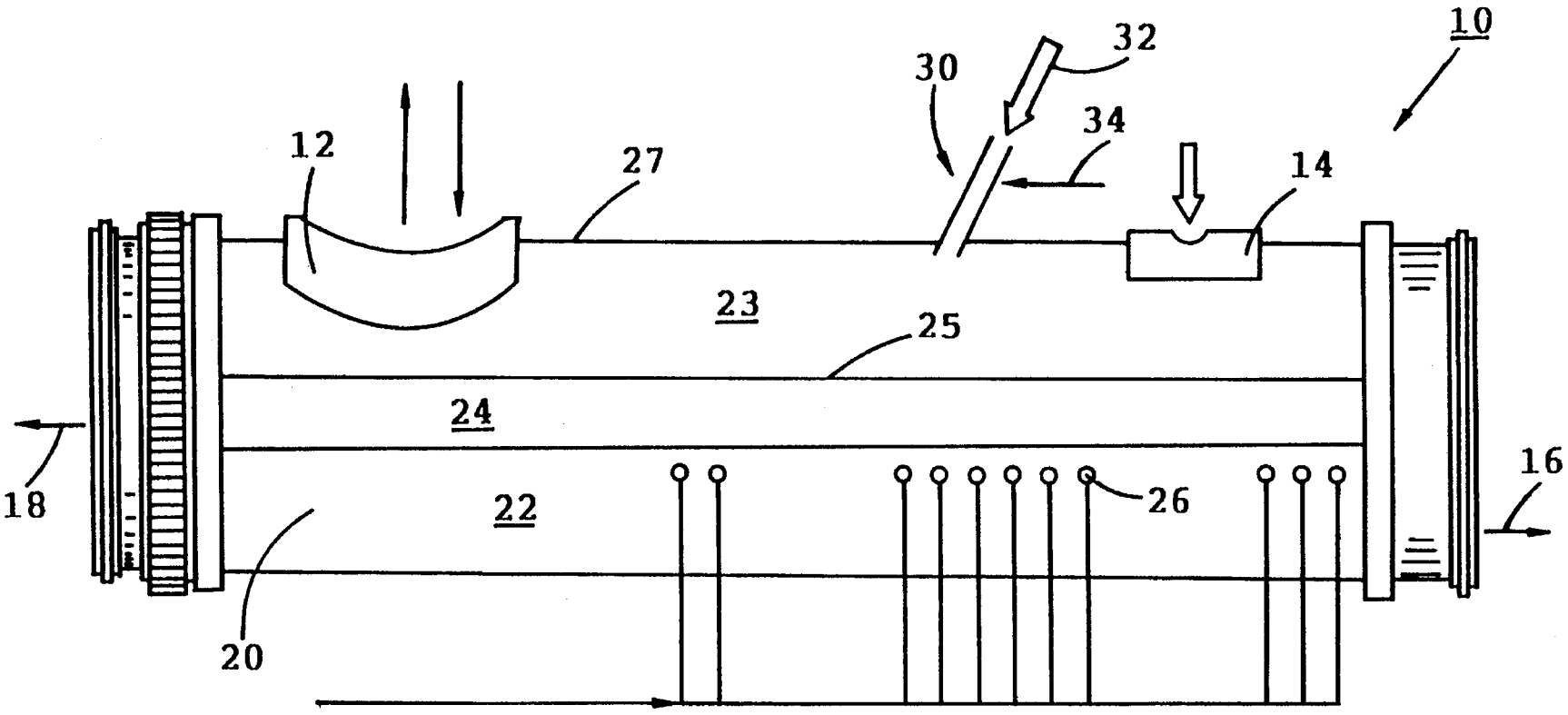
10
16
14
32
34
30
25
26
23
27
24
22
12
20
18

METHOD AND APPARATUS FOR TREATMENT SULPHIDIC CONCENTRATES

The present invention relates to a method and an apparatus for oxizidizing treatment of molten matte and at the same time directly smelting sulphidic concentrate in a refractory-lined metallurgical liquid bath reactor, e.g. a converter, into which oxidizing air is introduced below the surface of the liquid bath. The invention can be used for instance for producing copper from sulphide ores.

Thus, the present invention relates to a method of producing metal from sulphidic ore or sulphidic ore concentrate, wherein normally the concentrate is first treated in a smelting reactor, e.g. a reverberatory furnace, whereby molten matte is formed, whereafter the molten matte thus formed is treated in a liquid bath reactor, e.g. a converter, by means of oxidizing smelting for producing metal.

In conventional converter processes which have been developed during decades and are per se well known and easily controlled, surplus heat is produced when the molten matte is treated in the liquid bath reactor, which heat can be used for instance for smelting scrap. During the last decades attempts to use this surplus of heat have been made at several smelting plants for direct oxidizing smelting of fresh sulphidic concentrate in the liquid bath reactor. In direct oxidizing smelting of sulphidic concentrate, such as normal flotation concentrate, in a liquid bath reactor, converter or similar smelting means, for instance of shaft furnace type, with not preheated air, problems with the energy balance arise, because the oxidation reactions do not give sufficient heat for the whole converter process. External energy has to be supplied to the process. This energy can be supplied by addition of already molten matte fossil fuel or oxygen gas or oxygen-enriched air.

It is known, for oxidizing smelting of matte in a conventional converter, to directly smelt at the most approximately the same amount of moist sulphidic concentrate as the supplied amount of molten matte. Then, the molten matte supplies the additional energy needed for direct smelting of the concentrate. For smelting larger amount of concentrate than molten matte, other energy supplied from an external source is needed.

The use of oxygen gas, e.g. air enriched by 35–60% oxygen gas, as an external source of energy is a simple, effective and modern method. However, injection of oxygen-enriched air by means of conventional tuyeres disposed below the liquid bath in the converter causes damages both to the lining and the tuyeres, because of the extreme heat which is produced around the tuyeres. Thus, their durability limits the enrichment of the air by oxygen. As the content of oxygen in the air blast in a converter today should not exceed 30% $O_2$, this means that autogenous smelting of concentrate can not be achieved by the injection of oxygen-enriched air.

In order to prevent damages to the lining, the lining around the tuyeres can of course be cooled by water. However, this increases the heat losses significantly and further increases the $O_2$ demand. Furthermore, the water cooling below the surface of the bath is a potential security risk.

It is, of course, possible to use fossil fuels to increase the heat in the converter and achieve heat balance. However, this results in a larger flow of exhaust gas and more diluted $SO_2$-containing gases, which increases the costs of recovery of sulphur as sulphuric acid in the sulphuric acid plant.

The object of the present invention is to provide a method and an apparatus in which the drawbacks described above have been minimized.

The object of the present invention is particularly to provide a flexible method for direct smelting of sulphidic concentrate.

The method according to the present invention for oxidizing treatment of molten matte and at the same time directly smelting sulphidic concentrate is characterized in that, for additional supply of energy in order to achieve thermal balance or increase of capacity in the liquid bath reactor, at least a portion of the sulphidic concentrate is introduced into the gas phase of the liquid bath reactor together with oxygen gas or oxygen-enriched air through a concentrate burner, forming matte or metal.

The apparatus according to the invention for oxidizing treatment of molten matte and at the same time directly smelting sulphidic concentrate is correspondingly characterized in that a concentrate burner is disposed in the liquid bath reactor for introducing concentrate and oxygen gas or oxygen-enriched air above the surface of the liquid bath. The concentrate burner can be located in the roof of the converter or, for instance, in one end of a horizontal converter.

In order to avoid the drawbacks mentioned earlier, which occur in conventional liquid bath reactors in direct smelting of concentrate, it is according to the invention suggested that a concentrate burner should be used which is applied in the gas phase of the reactor. The concentrate burner produces, by using oxygen gas, oxygen-enriched air or preheated air, a matte which corresponds to the matte which normally is taken from a supplementary smelting furnace in order to achieve heat balance. In a converter according to the invention, in which at least the major part of the sulphidic concentrate directly supplied to the converter is introduced by means of a concentrate burner, the concentrate will have time to substantially react with the oxygen gas and smelt before it reaches the liquid bath.

By concentrate burner is here meant a device by means of which dry concentrate (possibly flotation concentrate of cupric sulphide ore) is mixed with gas containing oxygen gas so as to achieve a mixture which is as homogeneous as possibly. This mixture is caused to react immediately, whereby molten particles of matte and slag and sulphur dioxide are produced. The reactions will thus take place rapidly and completely, whereby a high efficiency for the oxygen in the combustion gas is achieved. Surplus oxygen is mixed with the gases ascending from the liquid bath. The reaction products, i.e. the molten particles of matte and slag, have a much smaller tendency to be entrained by the exhaust gases than pulverous concentrate. The hot addition of molten material supplies at the same time additional energy to the melt.

As a sufficient enrichment of the reaction air by oxygen, which is required because of the heat balance in direct smelting of concentrate, can not without drawbacks be achieved by adding oxygen gas to the air being injected through the tuyeres below the liquid bath, the necessary amount of oxygen gas is according to the invention supplied as high-enriched air through the concentrate burner. It is, of course, not necessary to reach autogenous conditions in the reactor, i.e. the converter, but this method can be used to solely improve the existing smelting capacity. If heat balance cannot be achieved even with high enrichment of the air by oxygen gas, additional fuel can be supplied through the concentrate burner.

Oxygen-enriched air with 40–70% oxygen gas or even pure oxygen gas can without drawbacks be used in a concentrate burner. The degree of enrichment by oxygen gas can be controlled according to the heat balance in the converter. The converter is preferably supplied with air or air enriched by just some oxygen gas through the tyueres below the liquid bath, while the concentrate burner is supplied with air having a higher concentration of $O_2$. As the concentrate burner according to the invention combusts concentrate freely in the gas space of the reactor, even a high concentration of $O_2$ will not effect the durability of the lining.

The content of copper in the matte which is formed from the concentrate supplied to the concentrate burner can also be controlled by means of the amount of oxygen gas in the air which is supplied through the concentrate burner. The larger the amount of oxygen gas is, the higher is the content of copper. By means of the enrichment by oxygen gas it is thus possible to control two supplied concentrate flows, i.e. the concentrate flow to the concentrate burner and the concentrate flow which is supplied directly to the liquid bath.

The invention will be further described with reference to the accompanying drawing, which illustrates schematically a converter for treating molten matte and direct smelting of concentrate.

BRIEF DESCRIPTION OF THE DRAWING

The drawing shows apparatus for treating sulphidic concentrates in accordance with the invention.

The figure shows a converter 10 of E1 Teniente type comprising a converter opening 12 for molten matte, an inlet 14 for concentrate, an outlet 16 for melt and a second outlet 18 for slag. The converter contains a liquid bath 20 consisting a melt 22 consisting of matte and metal and a layer of slag 24. A gas space 23 is formed between the slag surface 25 and the roof part 27 of the reactor. Tuyeres 26 for injection of air are disposed below the liquid bath.

Concentrate is introduced into the converter through the inlet 14 and as pretreated matte through the inlet 12. A concentrate burner 30 according to the invention for direct supply of concentrate 32 and oxygen-enriched air 34 is disposed in the roof part 27 of the converter. The concentrate burner may, if desired, be located in one end of the converter. If necessary, several burners may be provided for uniform supply of concentrate. The exhaust gases are removed through the inlet 12 for molten matte.

A converter of E1 Teniente type, in which a portion of the concentrate is introduced directly into the converter and in which the heat balance earlier has been achieved by supplying ready-molten matte, can thus according to the invention be provided with a concentrate burner with oxygen gas or oxygen-enriched air, whereby the demand of ready-molten matte will decrease or be entirely eliminated. According to the invention, it is possible to produce the amount of molten matte necessary for the heat balance directly by smelting concentrate in the concentrate burner. The total heat balance of the converter is dependent on the content of matte and can be controlled by the content of oxygen gas in the reaction air supplied to the concentrate burner.

A sulphidic concentrate having high contents of copper and nickel can according to the invention be introduced by means of the concentrate burner and be directly smelted in a smelting furnace of converter type, whereby a metal phase is formed directly in flame-smelting with, e.g. pure oxygen gas. Bottom blowing of the liquid bath is then needed for oxidation of the content of residual sulphur of the metal phase only.

By means of the method according to the invention it is also possible to easily increase the capacity of a smelting plant when the normal furnace for smelting of matte already is maximally utilized. By supplying additional molten matte through a concentrate burner, the total amount of supplied concentrate can easily be increased.

An additional advantage is achieved when concentrate according to the invention is supplied through a concentrate burner in molten condition, whereby the melt produced falls down in the liquid bath and remains there. In normal direct introduction of concentrate, a large amount of concentrate is discharged in form of fine dust with the exhaust gases, which decreases the yield of metal and causes an increased demand for gas cleaning.

It shall be understood that the invention is not limited to the described and illustrated embodiment, but shall include all embodiments within the scope of the inventive idea which is defined in the appended claims.

I claim:

1. A method for oxidizing treatment of molten matte and simultaneous direct smelting of sulphidic concentrate in a refractory-lined liquid bath reactor converter, into which oxidizing air is introduced below the surface of the liquid bath, wherein, for additional supply of energy in order to achieve thermal balance or increase of capacity in the liquid bath reactor, at least a portion of the sulphidic concentrate is introduced into a gas phase of the liquid bath reactor together with oxygen gas or oxygen-enriched air through a concentrate burner, for combusting and smelting concentrate in a gas space before it reaches the liquid bath.

2. A method according to claim 1, wherein any concentrate which is introduced directly into the converter is introduced by means of a concentrate burner for achieving an increase of the conversion capacity.

3. A method according to claim 1, wherein oxygen-enriched air is supplied to the liquid bath reactor through the concentrate burner.

4. A method according to claim 1, wherein oxygen gas is supplied to the liquid bath reactor through the concentrate burner.

5. A method according to claim 1, wherein an oxidizing gas having a higher concentration of oxygen gas is supplied to a converter through the concentrate burner than through air tuyeres below the melt in the converter.

6. A method according to claim 5, wherein oxygen-enriched air having an oxygen gas concentration of about 40–70% is supplied to the converter through the concentrate burner.

7. A method according to claim 1, wherein the sulphidic concentrate contains copper and the content of copper in the matte which is obtained from concentrate introduced through the concentrate burner and supplied to the oxidizing smelting in a converter is controlled by adjusting the amount of oxygen gas in the air which is supplied to the converter through the concentrate burner.

8. A method according to claim 1, wherein additional capacity in a converter is provided by increasing the amount of concentrate which is supplied through the concentrate burner.

9. A liquid bath reactor for oxidizing treatment of molten matte and simultaneous direct smelting of sulphidic concentrate, in which tuyeres are disposed in the liquid bath reactor for injection of air below the surface of a liquid bath in the reactor, and having inlets for molten matte and sulphidic concentrate above the surface of the liquid bath, wherein a concentrate burner is disposed in the gas phase of the liquid bath reactor for introducing concentrate above the surface of the liquid bath, for combusting and smelting concentrate in a gas space before it reaches the liquid bath.

10. An apparatus according to claim 9, wherein a concentrate burner is disposed in a converter in the roof part thereof.

* * * * *

UNITED STATES PATENT AND TRADEMARK OFFICE

CERTIFICATE OF CORRECTION

PATENT NO. : 5,574,956
DATED : November 12, 1996
INVENTOR(S) : Rolf Malmstrom

It is certified that error appears in the above-indentified patent and that said Letters Patent is hereby corrected as shown below:

Title Page, line 2 of title "TREATMENT SULPHIDIC CONCENTRATES" should read --TREATMENT OF SULPHIDIC CONCENTRATES--.

Column 1, line 2 of title "TREATMENT SULPHIDIC CONCENTRATES" should read --TREATMENT OF SULPHIDIC CONCENTRATES--.

Signed and Sealed this
Twenty-eighth Day of January, 1997

*Attest:*

Bruce Lehman

BRUCE LEHMAN

*Attesting Officer* *Commissioner of Patents and Trademarks*